US005823528A

United States Patent [19]

Draghetti et al.

[11] Patent Number: 5,823,528

[45] Date of Patent: Oct. 20, 1998

[54] DEVICE FOR FEEDING BLANKS ON A CIGARETTE PACKING MACHINE

[75] Inventors: Fiorenzo Draghetti, Medicina; Fulvio Boldrini, Ferrara, both of Italy

[73] Assignee: G.D Societa' Per Azioni, Italy

[21] Appl. No.: 792,995

[22] Filed: Feb. 3, 1997

[30] Foreign Application Priority Data

Feb. 2, 1996 [IT] Italy ..... BO96A0049

[51] Int. Cl.[6] ..... B65H 5/34

[52] U.S. Cl. ..... 271/270; 271/202; 271/216; 198/461.1; 131/84.1; 131/94; 131/282

[58] Field of Search ..... 53/579, 473, 202, 53/234, 384, 230; 131/84.1, 94, 282; 271/270, 271, 151, 182, 202, 206; 198/461.2, 461.1

[56] References Cited

U.S. PATENT DOCUMENTS

| | | | |
|---|---|---|---|
| 4,258,528 | 3/1981 | Folke | 53/473 |
| 4,612,756 | 9/1986 | Focke et al. | 53/579 |
| 4,918,908 | 4/1990 | Folke et al. | 53/579 |
| 5,282,614 | 2/1994 | Kalisiak et al. | 271/227 |
| 5,350,167 | 9/1994 | Hansch | 271/82 |
| 5,499,804 | 3/1996 | Hakada et al. | 271/3.02 |
| 5,636,832 | 6/1997 | Honegger et al. | 271/3.21 |

FOREIGN PATENT DOCUMENTS

| | | | |
|---|---|---|---|
| 2314103 | 1/1977 | France | 271/270 |
| 2375097 | 7/1978 | France | 271/270 |
| 2013631 | 8/1979 | United Kingdom | 271/270 |
| 1571465 | 7/1980 | United Kingdom | 271/270 |
| 1594974 | 8/1981 | United Kingdom | 271/270 |

*Primary Examiner*—Vincent Millin
*Assistant Examiner*—Charles W. Anderson
*Attorney, Agent, or Firm*—Klauber & Jackson

[57] ABSTRACT

A device for feeding blanks on a cigarette packing machine, wherein a succession of blanks, arranged side by side and overlapping one another along a supporting strip wound into a reel, is fed along a supply path by unwinding the reel and feeding the supporting strip along the path, which extends through a pitch-change device for spacing the blanks to eliminate the overlapping arrangement, and for adjusting the pitch of the blanks in a given manner.

14 Claims, 2 Drawing Sheets

DEVICE FOR FEEDING BLANKS ON A CIGARETTE PACKING MACHINE

BACKGROUND OF THE INVENTION

The present invention relates to a device for feeding blanks on a cigarette packing machine.

For packing cigarettes into packets, a succession of blanks is fed to the wrapping wheel of a packing machine by means of conveyors, e.g. of the type described in British Patent n. 1,571,465, which withdraw the blanks successively from a feedbox and feed them successively, side by side and a given distance apart, to a transfer device for transferring the blanks on to the wrapping wheel.

In view of the relatively low weight/area ratio of blanks for cigarette packets, and the ever-increasing output speed of modern cigarette packing machines, capable of producing more than five hundred cigarette packets per minute, known blank conveyors of the above type have required increasingly accurate position control features to prevent the blanks from being blown out of the respective seats on the conveyors.

In addition to increasing cost and reducing the reliability of the blank feed conveyors, the retaining forces applied by the feed conveyors to the blanks as they are fed along the supply path is often such as to result in damage.

In order to drastically reduce the aforementioned retaining forces and to increase, at the same time, the control on the position of the blanks along the supply path, the present invention provides for borrowing a technique which is normally used, for space saving purpose only, for feeding in succession, and at a relatively low frequency, large pieces of cardboard, sacks or the like along a feeding path to a user station. Such technique is disclosed in principle, for example, in FR-A-2 375 097.

SUMMARY OF THE INVENTION

According to the present invention, there is provided a device for feeding blanks on a cigarette packing machine and along a given supply path; the device being characterized by comprising first conveying means for feeding a number of blanks, so arranged to form a first succession of overlapping blanks with a first given pitch, in a given traveling direction and at a first speed along a first portion of said path; a pitch-change device located at an output end of said first portion of said path, and for so varying said first pitch as to eliminate said overlapping arrangement and form a second succession in which the blanks are spaced with a pitch at least equal to a dimension of the blanks parallel to said traveling direction; said pitch change device comprising accelerating means for accelerating each blank in relation to an adjacent blank located upstream in said traveling direction, and retaining means for retaining said adjacent blank so as to cause same to advance at said first speed; and second conveying means for feeding said second succession along a second portion of said path at a second speed.

The overlapping arrangement of the blanks described above provides, for a given output speed, for reducing the traveling speed of the blanks along said first portion of the supply path to less than a third of that of known conveyors, thus greatly reducing the ventilation forces to which the blanks are subjected. Moreover, since, in the overlapping arrangement, the upstream blank in the traveling direction of the blanks towards the wrapping wheel acts as a retaining element for the adjacent downstream blank, any external retaining elements, which are a major source of damage to the outside of the blanks, may be substantially eliminated.

BRIEF DESCRIPTION OF THE DRAWINGS

The invention will now be described by way of example only and with reference to the accompanying drawings, in which.

DETAILED DESCRIPTION OF THE INVENTION

Figures 1, 2:
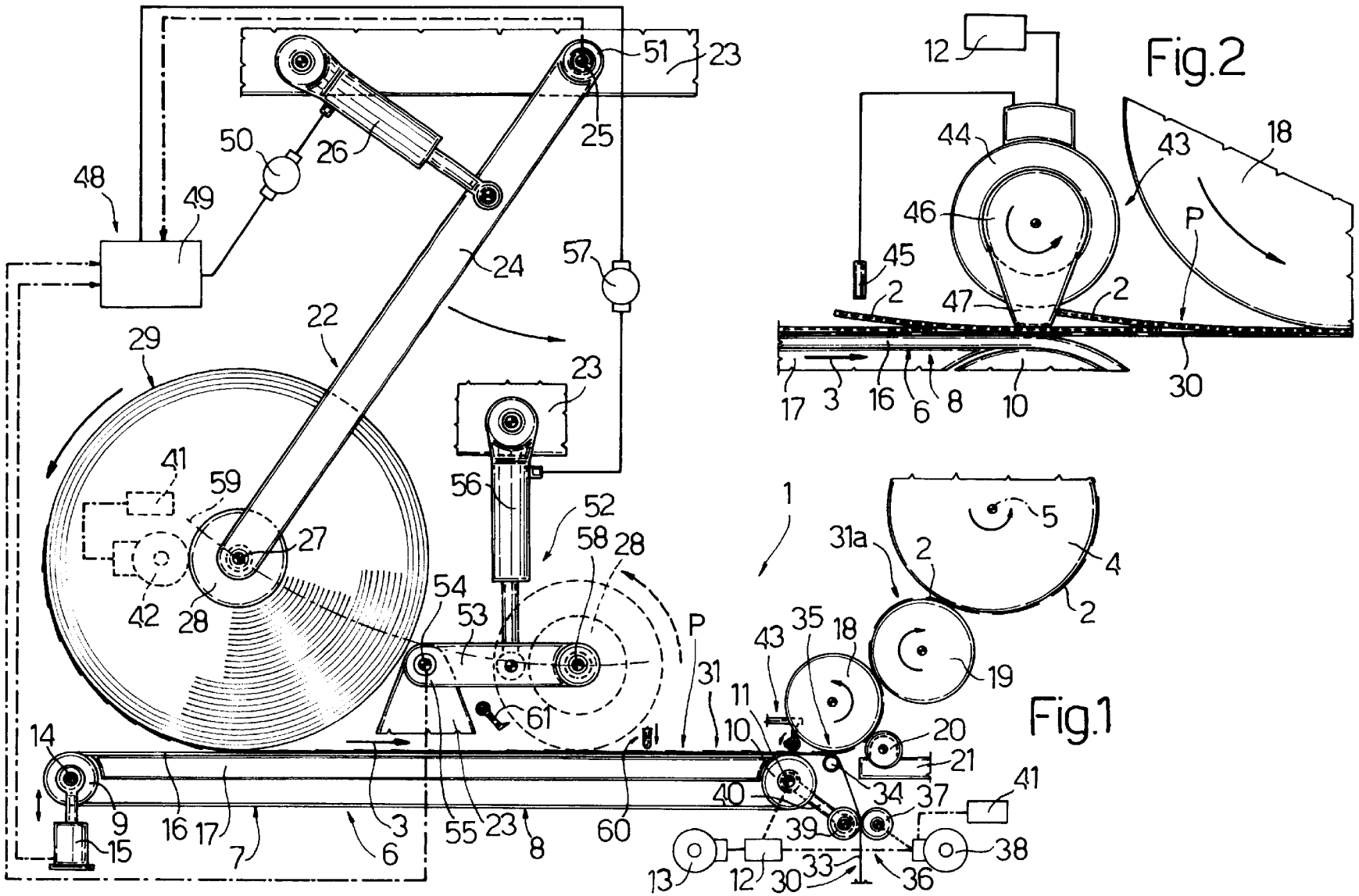
FIG. 1 shows a schematic side view, with parts in block form and parts removed for clarity, of a packing machine featuring a blank feed device in accordance with the present invention.
FIG. 2 shows a larger-scale view of a first detail in FIG. 1.

Number 1 in FIG. 1 indicates a machine for packing cigarettes in rigid hinged-lid packets (not shown) formed by feeding substantially elongated rectangular blanks 2 of cardboard or similar, in a direction 3 crosswise to their longitudinal axis, to a known wrapping wheel 4 rotating anticlockwise (in FIG. 1) about its axis 5.

Machine 1 comprises a supply line 6 for feeding blanks 2 to wrapping wheel 4, and which comprises a conveyor 7 presenting an air-permeable belt 8 looped about two transmission pulleys 9 and 10. Pulley 10 is fitted to a shaft 11 parallel to axis 5 and connected to an encoder 12 and to the output of a fixed motor 13 for rotating shaft 11 clockwise (in FIG. 1); and pulley 9 is fitted idly to a shaft 14 parallel to shaft 11 and in turn fitted to a load cell 15 for emitting a signal proportional to the transverse load applied to shaft 14, i.e. proportional to the tension of belt 8.

The upper branch 16 of belt 8 travels in direction 3 along a suction box 17 extending along substantially the whole length of branch 16, and defines the input portion of a path P along which blanks 2 are supplied to wheel 4. The output portion of path P is defined by two rollers 18 and 19, the first of which is a powered accelerating roller rotating anticlockwise (in FIG. 1) about an axis parallel to axis 5 and at a surface speed greater than the traveling speed of belt 8.

Roller 18 is located a given distance from and downstream from pulley 10 in direction 3, defines a passage with pulley 10, and is tangent to a roller 20 of a gumming device 21; and roller 19 is parallel and tangent to roller 18 and wheel 4, and rotates clockwise (in FIG. 1) at the same surface speed as wheel 4 and roller 18.

Line 6 also comprises a reel-holder device 22 in turn comprising a fixed frame 23 over branch 16 of belt 8, and an inclined arm 24 located over and to the side of branch 16 and connected at the top end to frame 23 by a pin 25 parallel to axis 5. Arm 24 is rotated about pin 25 by a linear actuator 26 interposed between frame 23 and an intermediate point of arm 24, and is fitted in rotary manner at the bottom end with a pin 27 parallel to pin 25 and movable axially by a known actuating device (not shown) between a withdrawn position and a position projecting from arm 24 directly over branch 16.

In use, pin 27 engages an end portion of the central hole (not shown) through the central core 28 of a reel 29 defined by a supporting strip 30 wound about core 28 to form successive turns, each of which is separated from the adjacent turn by an intermediate layer comprising a succession 31 of overlapping blanks 2, i.e. arranged so that the longitudinal axes of each pair of adjacent blanks 2 are separated by a distance smaller than the width of each blank, and the leading blank 2, i.e. closest to the free end of strip 30, overlaps the adjacent following blank 2.

Figure 3:
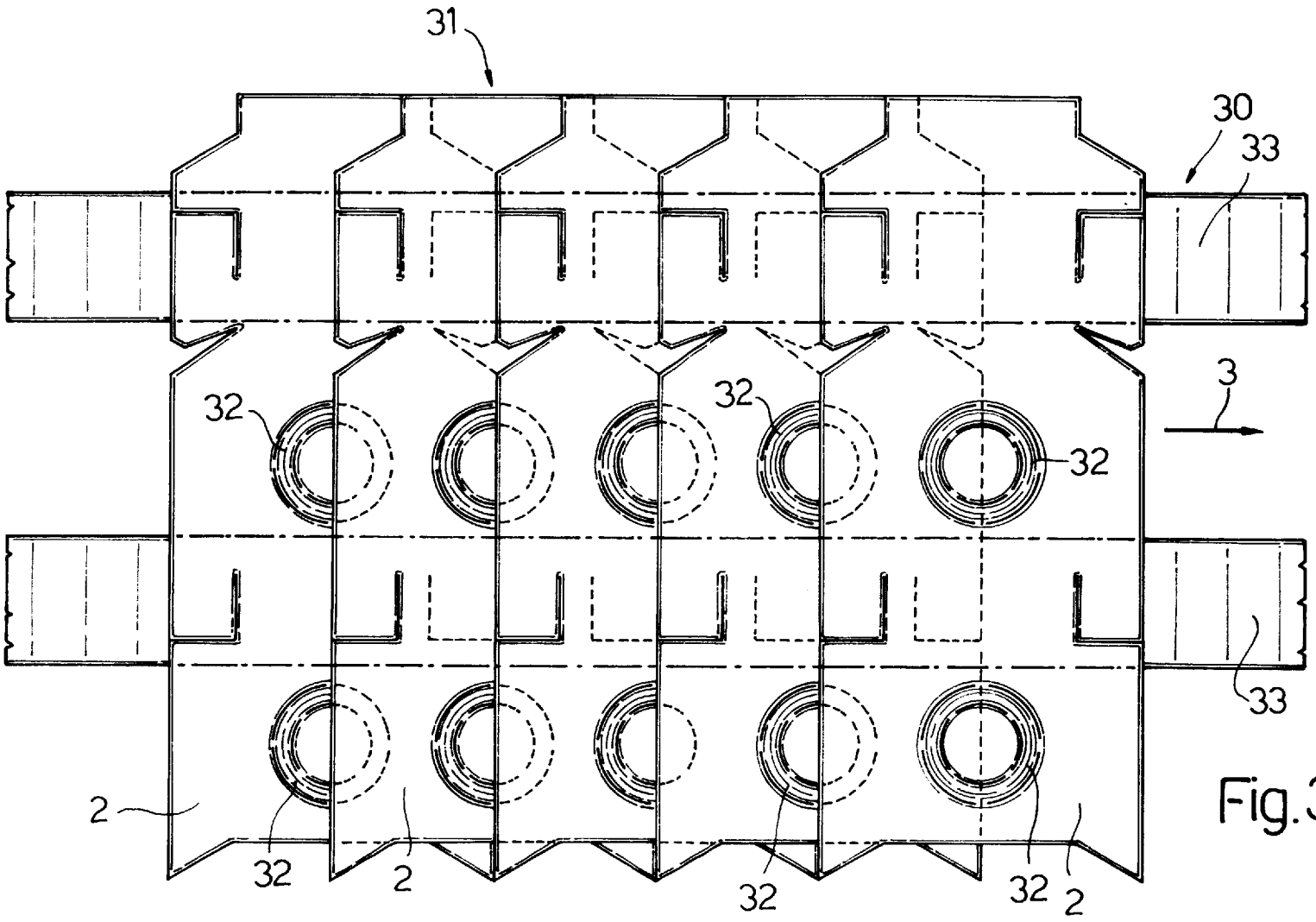
FIG. 3 shows a larger-scale plan view of a second detail in FIG. 1.

In the FIG. 3 embodiment, blanks 2 present projecting portions 32; and strip 30 is defined by two belts 33 so located as not to contact portions 32, and of a thickness at least equal to that of portions 32, so that the thickness of portions 32 is compensated by that of belts 33 and in no way affects the diameter of reel 29.

Line 6 comprises a diverting roller 34 located beneath roller 18 and upstream from roller 20, and defining, with roller 18, a pitch-change device or station 35; and line 6 also comprises an unwinding assembly 36 located beneath the output end of conveyor 7 and in turn comprising a roller 37 connected to the output of a motor 38, and a pressing roller 39, which is pushed on to roller 37 by a known spring-loaded arm 40. Motor 38 is controlled both by encoder 12 and by a known torque-limiting device 41 interposed between motor 38 and a motor 42 connected to pin 27, and which provides for activating motor 42 when the resisting torque of motor 38 exceeds a predetermined value.

Line 6 also comprises a brake device 43 shown in detail in FIG. 2 and in turn comprising a step motor 44, which is controlled both by encoder 12 and by a sensor 45 facing branch 16 of belt 8 immediately upstream from pulley 10, and provides for rotating (anticlockwise in FIG. 2) a cylindrical head 46 presenting a radial appendix 47. The free end of appendix 47 is separated from the axis of rotation of head 46 by a distance at least equal to the distance between said axis of rotation and branch 16 of belt 8, travels at least along part of its path at the same speed as belt 8, and engages branch 16 with a given contact pressure at each turn of head 46.

Finally, line 6 comprises a control unit 48 in turn comprising a central control unit 49 for controlling the operation and delivery of a pump 50 supplying actuating fluid to actuator 26 as a function of signals received from cell 15 and from a detector 51 for determining the angular position of arm 24.

Operation of machine 1 will now be described as of the instant in which pin 27 is unloaded and motors 13, 38, 42 and 44 are off.

As of the above condition, a full reel 29 is placed close to machine 1; actuator 26 is operated to rotate arm 24 clockwise (in FIG. 1) so that pin 27 is separated from branch 16 of belt 8 of conveyor 7 by a distance greater than the diameter of reel 29; pin 27 is then set to the extracted position and reel 29 fitted on to pin 27 in the unwinding position; central control unit 49 activates pump 50 to rotate arm 24 anticlockwise about pin 25 and so bring the periphery of reel 29 up to branch 16 of belt 8; and a given initial length of strip 30, with no blanks 2, is unwound off reel 29 and fed manually along branch 16, beneath brake device 43, through the passage between pulley 10 and roller 18, between rollers 18 and 34 of pitch-change device 35, and between rollers 37 and 39 of assembly 36.

At this point, pump 50 is again operated to lower reel 29 further so that its periphery rests on branch 16, thus exerting on branch 16, and hence shaft 14, a tension which is measured by load cell 15. When the tension reaches a given value, central control unit 49 stops pump 50—which is subsequently so controlled as to maintain a given tension of branch 16—and activates motors 13, 38 and 44.

When motors 13 and 38 are activated, branch 16 is fed in direction 3 at a given constant speed, and strip 30 is unwound off reel 29 at the same speed. When reel 29 is substantially full, motor 38 is assumed unable to unwind strip 30 alone, and therefore activates motor 42 by means of device 41.

Once a number of empty turns are eliminated, strip 30 begins feeding succession 31 of overlapping blanks 2 along branch 16 of belt 8, so that blanks 2 travel successively beneath brake device 43, the appendix 47 of which contacts each blank 2 just behind the rear edge of the foregoing blank 2 as the foregoing blank 2 reaches device 35 and is engaged by roller 18. Appendix 47 is so sized that the blank 2 engaged by it is pressed on to branch 16 of belt 8, thus preventing the removal of two or more blanks 2 at a time by roller 18, and enabling roller 19, and hence wheel 4, to be supplied with a succession 31*a* of blanks 2, in which, as opposed to overlapping, blanks 2 present a constant pitch at least equal to their width measured in traveling direction 3. The rotation speed of appendix 47 is controlled by encoder 12 over the portion of its travel in contact with blank 2, and by sensor 45 over the remainder of its rotation; and sensor 45 detects the passage of the rear edge of each blank, and so controls motor 44 that appendix 47 is brought into contact with each blank 2 immediately downstream from the rear edge of the foregoing blank 2.

Blanks 2 in succession 31 are therefore arranged with a relatively small pitch as compared with that of succession 31*a*, so that, for a given number of blanks 2 supplied per unit of time to wheel 4, the traveling speed of blanks 2 in succession 31 is relatively slower than, and in the example shown almost a third of, that of blanks 2 in succession 31*a*. By virtue of their overlapping arrangement and relatively slow traveling speed, the blanks in succession 31 therefore require no retaining or guide devices.

As shown in FIG. 1, line 6 comprises a reel-change device 52 located between arm 24 and brake device 43, over branch 16 of belt 8, and in turn comprising an arm 53 located over branch 16 and on the opposite side of branch 16 to arm 24. Arm 53 is connected at one end to frame 23 by a pin 54 parallel to pin 25, and is rotated about pin 54 under the control of an angular position detector 55 and by a linear actuator 56 interposed between frame 23 and an intermediate point of arm 53 and supplied by a pump 57 controlled by central control unit 49. The free end of arm 53 is fitted in rotary manner with a pin 58 parallel to pin 54 and projecting from arm 53 directly over branch 16.

Pin 58 is movable axially in relation to arm 53 by a known actuator (not shown) to engage an end portion of the central hole (not shown) through core 28 opposite the end portion engaged in use by pin 27, and is normally maintained by arm 53 in a standby position (FIG. 1) along the circular trajectory 59 of pin 29 about pin 25.

Device 52 also comprises a known splicing device 60 located facing branch 16 between arm 53 and brake device 43; and a known cutting device 61 located between arm 53 and branch 16.

In actual use, as strip 30 is unwound, the diameter of reel 29, which is maintained contacting branch 16 of belt 8 by actuator 26, gradually gets smaller so that arm 24 gradually rotates anticlockwise (in FIG. 1) to move pin 27 along trajectory 59. This continues until detector 51 indicates pin 27 is coaxial with pin 58, and simultaneously releases pin 27 and activates pin 58, which is inserted inside core 28 to free it of pin 27 and release arm 24 from reel 29, which remains connected to arm 53 by pin 58.

At this point, arm 24 is free to move back and receive a new reel 29, while the old reel continues to be unwound on pin 58; arm 24 is set to a standby position; and a portion of strip 30 with no blanks 2 is laid along branch 16 up to a point just upstream from the reel 29 being unwound.

On detecting only a few turns of strip 30 with no blanks 2 are left on core 28, detector 55 activates both suction box 17, which makes strip 30 of the new reel 29 and branch 16 integral with each other, and cutting device 61, which cuts the trailing end portion of strip 30 of the run-out reel 29 and places it on top of the leading end portion of strip 30 of the new reel. By virtue of suction box 17, the two superimposed end portions of strip 30 proceed at the same speed towards assembly 36 and are spliced by device 60.

At this point, the run-out reel 29 is unloaded off pin 58 and the new reel 29 is unwound.

We claim:

1. A device for feeding blanks (2) on a cigarette packing machine (1) and along a given supply path (P); the device (6) being characterized by comprising first conveying means (7, 30) for feeding a number of blanks (2), so arranged to form a first succession (31) of overlapping blanks (2) with a first given pitch, in a given traveling direction (3) and at a first speed along a first portion of said path (P); a pitch-change device (35) located at an output end of said first portion of said path (P), and for so varying said first pitch as to eliminate said overlapping arrangement and form a second succession **(31*a*) in which the blanks (2) are spaced with a pitch at least equal to a dimension of the blanks parallel to said traveling direction (3); said pitch change device comprising accelerating means (18) for accelerating each blank (2) in relation to an adjacent blank (2) located upstream in said traveling direction (3), and retaining means (43) for retaining said adjacent blank (2) so as to cause same to advance at said first speed; and second conveying means (18, 19) for feeding said second succession (31*a*)** along a second portion of said path (P) at a second speed.

2. A device as claimed in claim 1, characterized in that said first conveying means (7, 30) comprise a strip (30) for supporting said first succession (31) of blanks (2); at least one supporting device (22) located along said first portion of said path (P), and for supporting a respective reel (29) formed by winding said strip (30) about a central core (28) to grip said blanks (2) between adjacent turns of the reel (29); and traction means (36) for unwinding said strip (30) off said reel (29) and feeding said strip (30) along said first portion of said path (P) in said traveling direction (3) and at said first speed.

3. A device as claimed in claim 2, characterized in that said first conveying means (7, 30) also comprise a conveying device (7) movable in said traveling direction (3) at said first speed and extending along said first portion of said path (P) to support said strip (30).

4. A device as claimed in claim 3, characterized in that said conveying device (7) and said second conveying means (18, 19) are located a given distance from one another to define a passage; said traction means (36) being located on the opposite side of said first conveying means (7, 30) to said strip (30); and said strip (30) extending through said passage.

5. A device as claimed in claim 3, characterized in that said supporting device (22) comprises a fixed frame (23); a first arm (24) fitted to the frame (23) so as to rotate, in relation to the frame (23), about an axis (25) crosswise to said traveling direction (3); and a first pin (27) located at a free end of the first arm (24) and parallel to the axis (25) of rotation of the first arm (24); said first pin (27) facing said conveying device (7) and engaging the core (28) of said reel (29).

6. A device as claimed in claim 5, characterized in that said supporting device (22) also comprises first actuating means (26) interposed between the first arm (24) and the frame (23) to move the first pin (27) along a circular trajectory (59) and, in use, maintain said reel (29) resting on said conveying device (7) with a given pressure.

7. A device as claimed in claim 6, characterized by also comprising a reel-change device (52) facing said conveying device (7) and located downstream from said supporting device (22) in said traveling direction (3).

8. A device as claimed in claim 7, characterized in that said reel-change device (52) comprises a second arm (53) fitted to said frame (23) so as to rotate, in relation to the frame (23), about an axis (54) crosswise to said traveling direction (3); a second pin (58) located at a free end of the second arm (53) and parallel to the axis (54) of rotation of the second arm (53), said second pin (58) facing said conveying device (7) and engaging the core (28) of said reel (29); and second actuating means (56) interposed between the second arm (53) and the frame (23) to maintain the second arm (53) in a standby position in which the second pin (58) is located along said trajectory (59) of the first pin (27) and on the opposite side of said conveying device (7) to said first pin (27), and, in use, to maintain said reel (29) resting on the conveying device (7) with a given pressure.

9. A device as claimed in claim 8, characterized in that the reel-change device (52) also comprises splicing means (60) for splicing two said strips (30) superimposed one on top of the other on said conveying device (7).

10. A device as claimed in claim 2, characterized in that said blanks (2) comprise projecting portions (32); said strip (30) being defined by at least two belts (33) for so supporting the blanks (2) that said projecting portions (32) do not come into contact with said belts (33).

11. A device as claimed in claim 1, characterized in that, in said overlapping arrangement, each blank (2) overlaps the adjacent blank (2) located immediately upstream in said traveling direction (3); said accelerating means (18) comprising an accelerating roller (18) presenting a surface speed greater than said first speed, and for engaging and moving each said blank (2) away from said adjacent blank (2) located immediately upstream in said traveling direction (3).

12. A device as claimed in claim 11, characterized in that said pitch-change device (35) also comprises a diverting roller (34) substantially tangent to the accelerating roller (18); said strip (30) extending about said diverting roller (34).

13. A device as claimed in claim 1, characterized in that said retaining means (43) comprise a brake device (43) located upstream from the pitch-change device (35) in said traveling direction (3) and associated with the pitch-change device (35); the brake device (43) cooperating with each pair of adjacent blanks (2) wherein a first blank (2) is engaged by said accelerating means (18), and a second blank (2) is located partly beneath and in contact with the first blank (2) and upstream from the first blank (2) in said traveling direction (3); and the brake device (43) comprising movable pressure means (44, 46, 47) for cyclically engaging said first conveying means (7, 30) at a speed equal to said first speed, to retain each said second blank (2) contacting the first conveying means (7, 30) for at least the time taken by said first blank (2) to be detached from the second blank (2) by said accelerating means (18).

14. A device as claimed in claim 13, characterized in that said movable pressure means (44, 46, 47) comprise a rotary head (46) facing said first conveying means (7, 30); and an appendix (47) extending radially outwards from said head (46) and movable with the head (46) about an axis crosswise to said traveling direction (3) and separated from said first conveying means (7, 30) by a distance at most equal to a length of said appendix (47).

* * * * *